US007745764B2

(12) United States Patent
Tenzek

(10) Patent No.: US 7,745,764 B2
(45) Date of Patent: Jun. 29, 2010

(54) METHOD AND APPARATUS FOR CONTROLLING FURNACE POSITION IN RESPONSE TO THERMAL EXPANSION

(75) Inventor: Anthony M. Tenzek, Hanoverton, OH (US)

(73) Assignee: Ajax Tocco Magnethermic Corporation, Euclid, OH (US)

( * ) Notice: Subject to any disclaimer, the term of this patent is extended or adjusted under 35 U.S.C. 154(b) by 737 days.

(21) Appl. No.: 11/451,960

(22) Filed: Jun. 13, 2006

(65) Prior Publication Data

US 2007/0125769 A1 Jun. 7, 2007

Related U.S. Application Data

(60) Provisional application No. 60/748,872, filed on Dec. 7, 2005.

(51) Int. Cl.
*H05B 6/10* (2006.01)
*F27B 9/14* (2006.01)

(52) U.S. Cl. ..... 219/634; 373/144; 432/122

(58) Field of Classification Search ..... 219/634, 219/615, 602, 604, 607, 616, 617, 635, 672; 425/143, 149, 411; 423/291, 297; 373/140, 373/144; 422/199
See application file for complete search history.

(56) References Cited

U.S. PATENT DOCUMENTS

| | | | | |
|---|---|---|---|---|
| 2,457,846 A | | 1/1949 | Strickland | |
| 3,180,917 A | * | 4/1965 | Morrison et al. | 219/634 |
| 3,535,080 A | | 10/1970 | Van Der Pyl | |
| 3,926,415 A | | 12/1975 | Konas et al. | |
| 4,117,252 A | | 9/1978 | McMaster | |
| 4,174,462 A | | 11/1979 | Pearce | |
| 4,764,108 A | | 8/1988 | Carthew et al. | |
| 4,825,069 A | | 4/1989 | Hutchisson et al. | |
| 5,443,383 A | * | 8/1995 | Kuehn | 432/122 |
| 6,162,298 A | | 12/2000 | Rudolph | |
| 6,457,971 B2 | | 10/2002 | Orbeck | |
| 6,898,232 B2 | | 5/2005 | Miller et al. | |
| 2005/0003037 A1 | * | 1/2005 | Huang et al. | 425/143 |

FOREIGN PATENT DOCUMENTS

| | | |
|---|---|---|
| EP | 0 209 339 A2 | 1/1987 |
| EP | 0 754 246 B9 | 4/2001 |

* cited by examiner

*Primary Examiner*—Quang T Van
(74) *Attorney, Agent, or Firm*—Sand & Sebolt

(57) ABSTRACT

A compression system for an inductively heated pusher furnace controls movement of susceptors during thermal contraction thereof. The system includes a plurality of furnace sections each having a susceptor wherein each susceptor abuts an adjacent susceptor and wherein the susceptors include first and last susceptors. A compression plate abuts the first susceptor to apply force thereon toward the last susceptor to keep the susceptors in abutment with each other during contraction of the susceptors during cooling thereof. An actuator for moving the compression plate is preferably automatically controlled by a computerized control system. The susceptors together form a tunnel through which pusher plates travel and have overlapping joints which seal against the escape of gasses and allow for a degree of susceptor contraction without forming a gap therebetween even in the absence of compression of the susceptors.

21 Claims, 6 Drawing Sheets

METHOD AND APPARATUS FOR CONTROLLING FURNACE POSITION IN RESPONSE TO THERMAL EXPANSION

CROSS REFERENCE TO RELATED APPLICATIONS

This application claims priority from U.S. provisional application Ser. No. 60/748,872 filed Dec. 7, 2005; the disclosure of which is incorporated herein by reference.

BACKGROUND OF THE INVENTION

1. Technical Field

This invention generally relates to pusher furnaces. More particularly, the invention relates to a method and apparatus for controlling the position of the sections of a pusher furnace in response to changes in temperature. Specifically, the invention relates to a compression system which engages at least one furnace section and applies pressure thereto to maintain contact between adjacent furnace sections in the pusher furnace.

2. Background Information

Pusher furnaces are designed in various lengths and may contain multiple heating and cooling sections as required by the application. These furnaces include a substantially continuous flat surface or a pair of slide rails running through the interior of the furnace. A plurality of pusher plates, carrying the material to be processed on their upper surfaces, are pushed sequentially along the flat surface and through the heating sections. Materials processed in this manner may include various materials required for electronic or ceramic components, as well as different metals that are to be annealed, sintered or de-waxed. In order to process a particular material properly, that material typically has to be subjected to very specific temperatures and atmospheric conditions as it passes through the furnace.

When the individual heating sections are heated, the overall length of the longitudinally extending furnace increases, sometimes by as much as several inches. Each heating section may be heated to a different temperature and consequently adjacent heating sections will likely expand to differing degrees. Furthermore, if the pusher furnace needs to be shut down in an emergency situation, for example, the various heating sections will tend to cool down at differing rates and, consequently, the heating sections may shrink to differing degrees. This difference in cooling rates can result in adjacent heating sections pulling apart from each other as they contract, thus creating gaps between the adjacent heating sections. Heat and gasses escape through these gaps, potentially causing damage to insulation within the sections and even potentially increasing the risk of catastrophic explosions. Even if the escaping heat and gasses do not cause explosions, they do cause a sudden change in the thermal and atmospheric conditions within the adjacent heating sections and thereby likely lead to damage of the materials being processed.

There is therefore a need in the art for a method and apparatus for keeping the heating sections in a pusher furnace substantially in contact with each other, thereby maintaining the temperature gradients over the entire length of the longitudinally extending furnace.

SUMMARY OF THE INVENTION

The present invention provides a furnace unit having first and second opposed ends and including a plurality of furnace sections each having a susceptor; wherein each susceptor abuts an adjacent susceptor; wherein the susceptors include first and last susceptors respectively adjacent the first and second ends of the furnace unit; a movable member which abuts the first susceptor for applying a force on the first susceptor toward the last susceptor whereby the movable member is adapted to keep the susceptors in abutment with each other during contraction of the susceptors during cooling thereof; and an actuator for moving the movable member.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
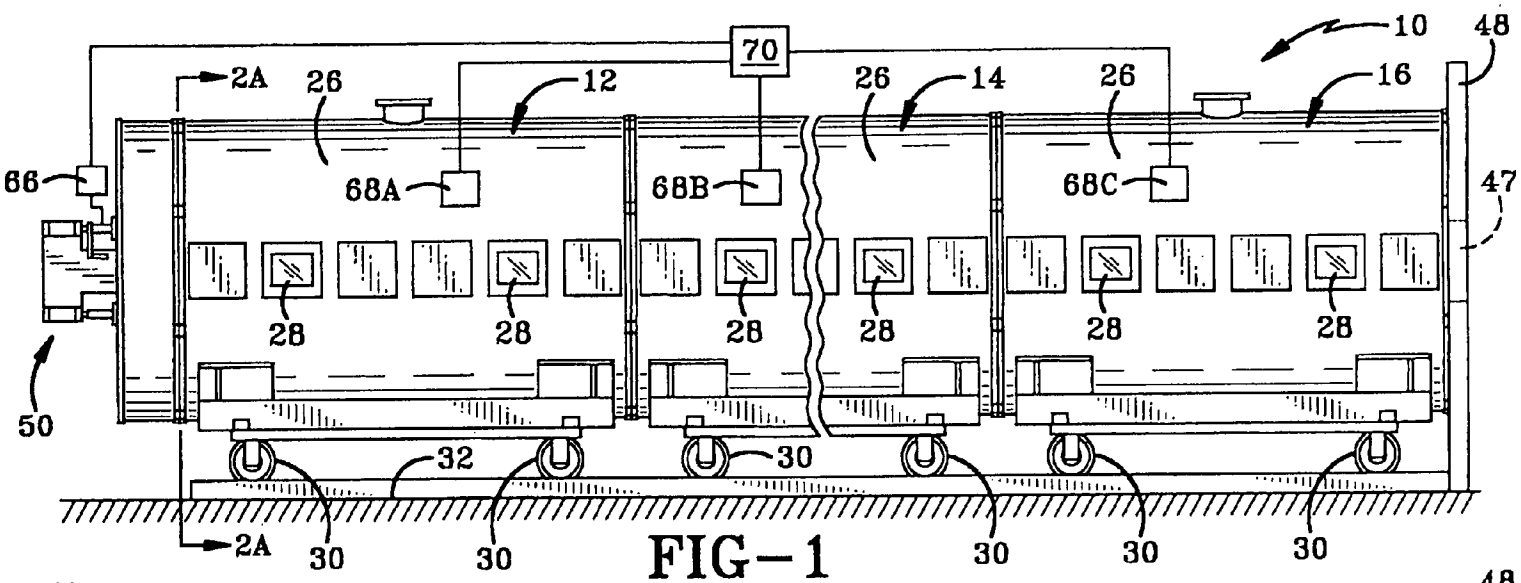
FIG. 1 is a side elevational view of a pusher furnace incorporating the compression system of the present invention.

Referring to FIGS. 1-6, there is shown a pusher furnace 10 comprising a plurality of furnace sections in the form of heating sections 12, 14 and 16 that are disposed in abutting end to end contact with each other to form a longitudinally extending furnace. The length of this longitudinally extending furnace may be as much as 60 feet and may further include both heating sections and cooling sections.

Each heating section 12, 14 and 16 is substantially identically constructed. The following description relates to heating section 12, but applies generally to heating sections 14 and 16 as well. Heating section 12 includes an interior passageway 18 (FIG. 3) defined by a susceptor 20, preferably manufactured from graphite. Susceptor 20 is surrounded by a plurality of layers of insulation 22, an induction coil 24, one or more Faraday rings 25 (FIG. 5) and an outer vessel 26. Faraday rings 25 are described in greater detail in the copending application having Ser. No. 60/749,015 and entitled Induction Coil Having Internal And External Faradic Rings, which was filed on Dec. 7, 2005 and is incorporated herein by reference. Induction coil 24 is mounted onto an interior surface of outer vessel 26 within an interior chamber 27 defined thereby. Coil 24 is spaced inwardly from outer vessel 26. The control panels (not shown), observation windows 28 and any other similar components are provided on the exterior surface of outer vessel 26 so that they may be easily accessed. Heating section 12 is provided with a plurality of wheels 30 that allow it to be moved across a surface 32 if need be.

Figure 2:
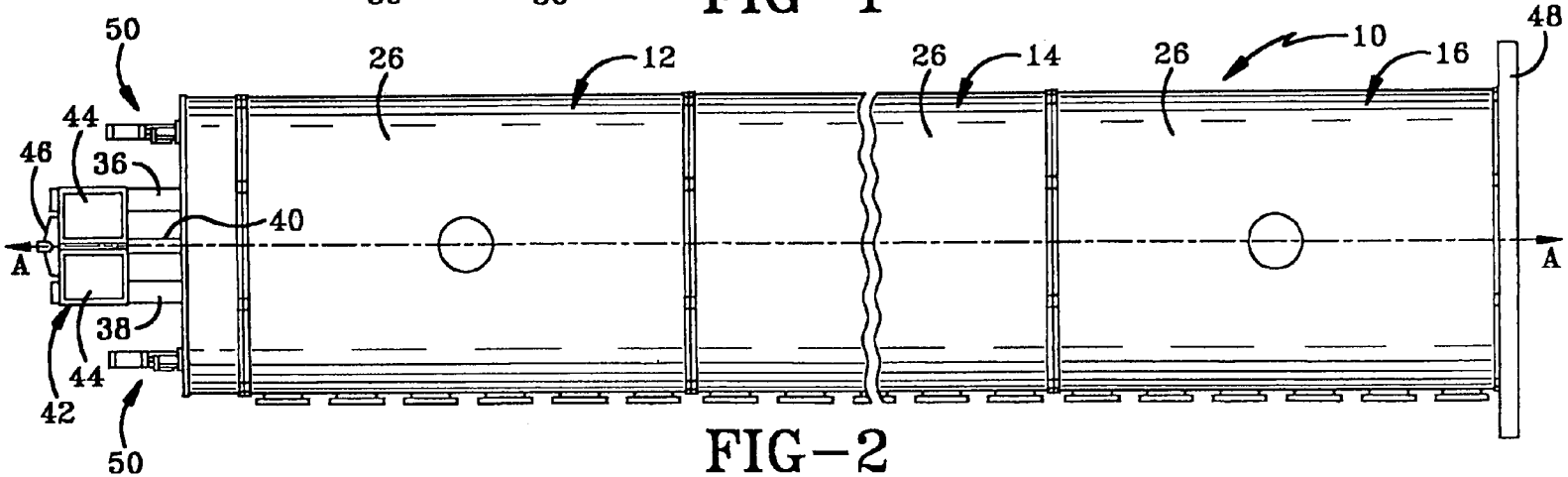
FIG. 2 is a top view of the pusher furnace shown in FIG. 1.
Figure 2A:
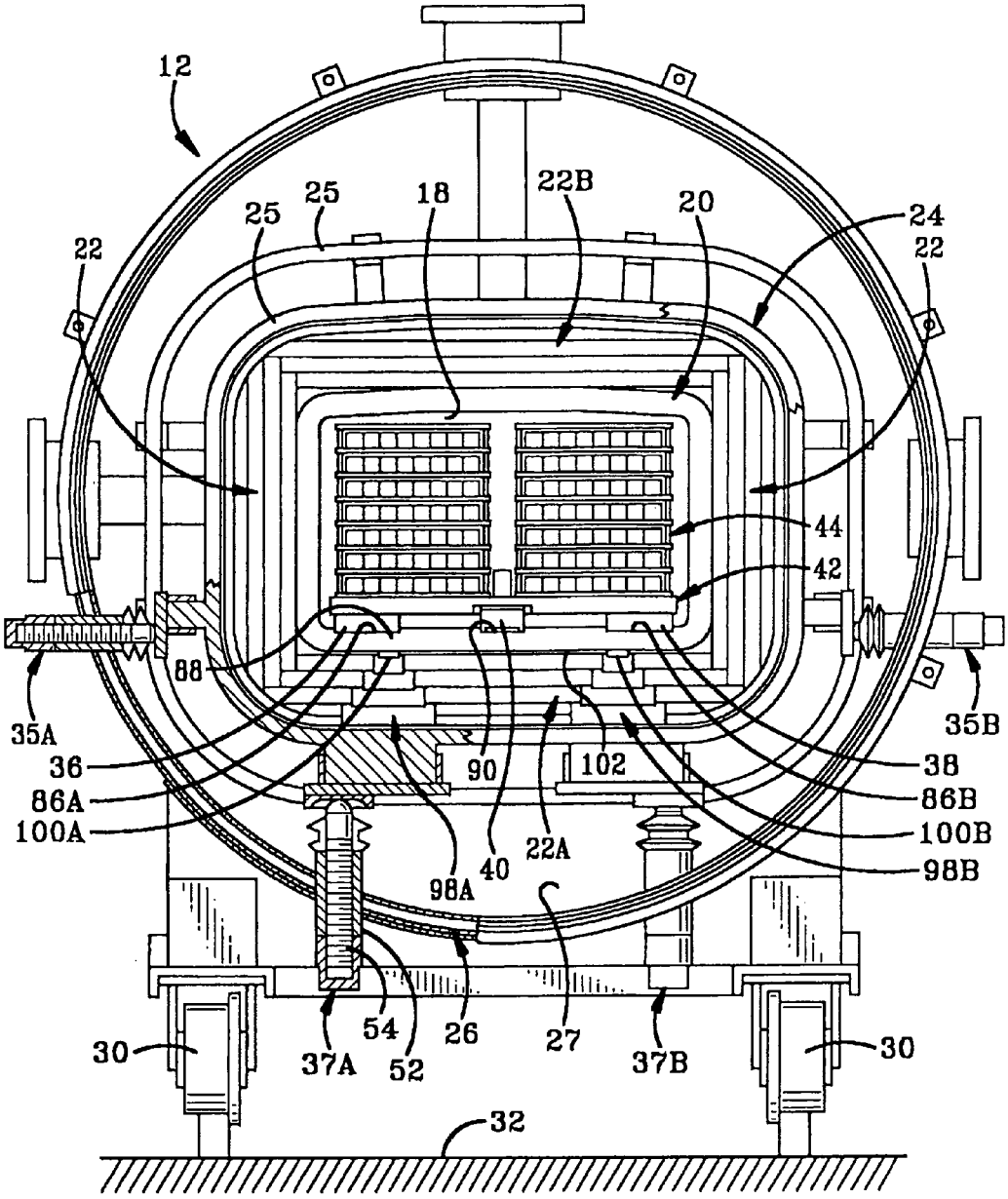
FIG. 2A is a sectional view taken on line 2A-2A of FIG. 1 with portions cut away.
Figure 3:
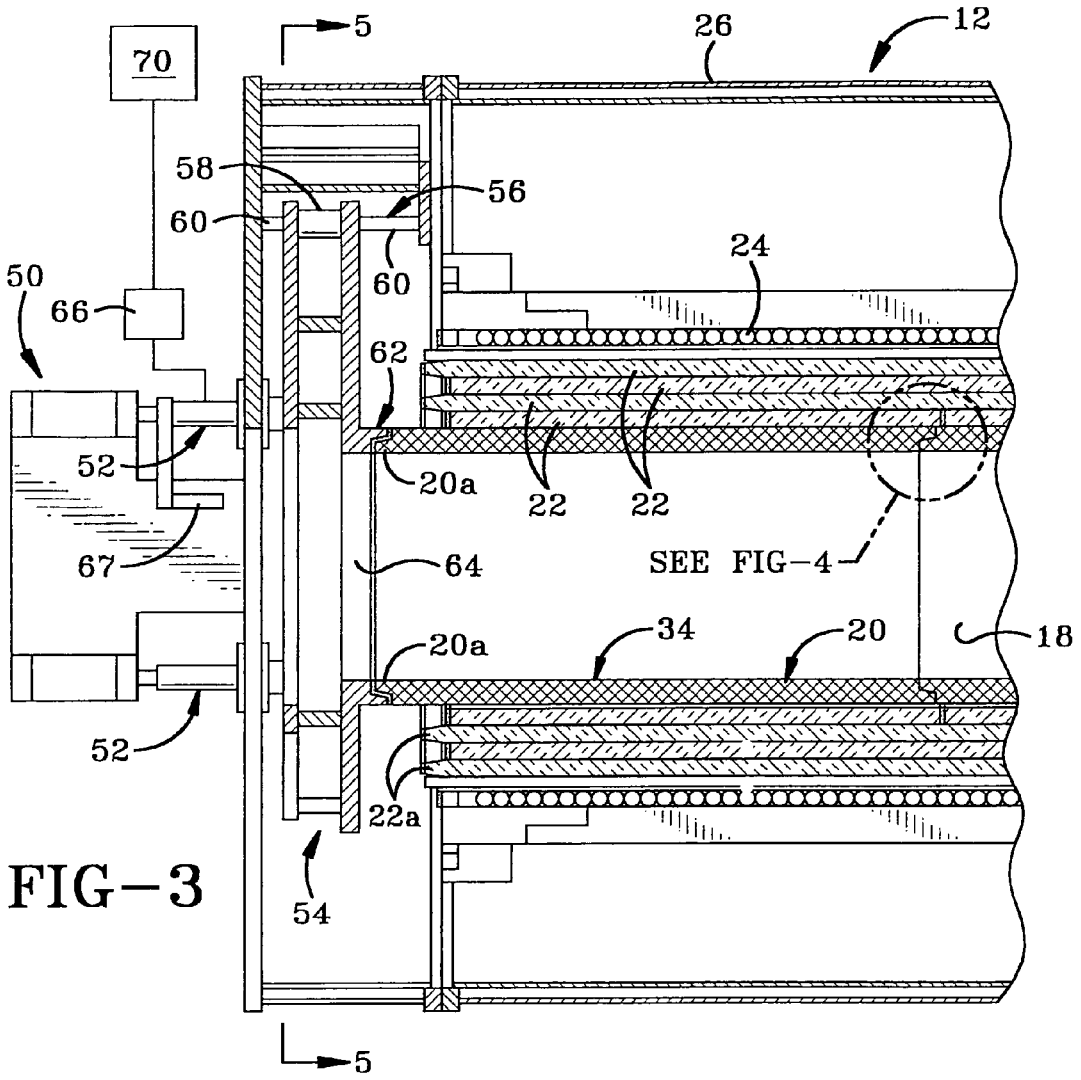
FIG. 3 is a cross-sectional side view of a first end of the pusher furnace showing the compression system of the present invention.

The susceptors 20 of adjacent heating sections 12, 14 and 16 must be kept in substantially continuous abutting contact with each other in order to prevent leakage of heat and process gasses from within passageway 18. Therefore, as may be seen from FIG. 3, the ends 20*a* and 22*a* of susceptor 20 and layers of insulation 22 are configured to form overlapping joints in the form of shiplap joints with the susceptor and insulation layers of the next adjacent heating section. Alternatively, the susceptors 20 and insulation layers 22 of adjacent heating sections 12,14, 16 are interlocked with each other by way of tongue-in-groove type joints. This causes the passageways 18 of the individual heating sections 12, 14 and 16 to form a substantially continuous tunnel 34 that extends from the first heating section 12 through to the last heating section 16. First and second horizontal adjustment screw assemblies 35A and 35B (FIG. 2A) are disposed adjacent each end of each heating section 12, 14, 16. First and second vertical adjustment screw assemblies 37A and 37B are also disposed adjacent each end of each heating section 12, 14, 16. Assemblies 35 and 37 are described in greater detail in the copending application having Ser. No. 60/748,819 and entitled Furnace Alignment System which was filed on Dec. 7, 2005 and is incorporated herein by reference.

A materials transport system extends through tunnel 34 and comprises a pair of spaced apart slide rails 36, 38 and a guide rail 40 disposed centrally between them. Slide rails 36, 38 and guide rails 40 are seated on susceptors 20 respectively within mating recesses 86A, 86B and 90 formed in a bottom wall 88 of susceptor 20. A plurality of pusher plates 42 are provided for transporting materials 44 through heating sections 12, 14 and 16. A pusher arm 46 is provided to push pusher plates 42, and therefore materials 44, into tunnel 34 and through heating sections 12, 14 and 16. Pusher plates 42 are slidably moved atop rails 36, 38 through tunnel 34 along a longitudinal axis of travel indicated at A-A in FIG. 2. Pusher plate 42 and the now-processed materials exit furnace 10 through an aperture 47 in end wall 48 (FIG. 1). Pusher plates 42 are moved in a continuous manner through the furnace as more particularly detailed in the copending application having Ser. No. 60/749,320 and entitled Method And Apparatus To Provide Continuous Movement Through A Furnace, which was filed on Dec. 7, 2005 and is incorporated herein by reference. The configuration of pusher plates 42 is more particularly detailed in the copending application having Ser. No. 60/749,016 and entitled Guidance System For Pusher Plate For Use In Pusher Furnaces, which was filed on Dec. 7, 2005 and is incorporated herein by reference.

First and second axially spaced and longitudinally elongated pedestals or supports 98A and 98B which are seated within induction coil 24. Supports 98 extend substantially the same length as susceptor 20 and insulation layers 22. Respective layers of graphoil 100A and 100B or a graphoil type material are seated respectively atop supports 98A and 98B along the length thereof in respective recesses formed therein. More particularly, bottom wall 88 of susceptor 20 is spaced upwardly of bottom insulation layers 22A to define a space 102 therebetween. Thus, susceptor 20 is supported entirely on layers of graphoil 100 and do not contact bottom insulation layers 22A. This arrangement helps to preserve bottom insulation layers 22A by eliminating the weight and friction thereon of susceptor 20 and any weight contributed thereto by top insulation layers 22B and any other related structure. This also eliminates degradation due to differing thermal expansion and contraction rates during heating and cooling of susceptor 20 and bottom insulation layers 22A which would occur if the susceptor were seated atop the insulation. Graphoil 100 provides a low-friction material which allows for the thermal expansion and contraction of susceptor 20 without substantial wear caused by the engagement therebetween. The arrangement of supports 98, layers 100 and related structure of the present invention is further described in the copending application entitled Furnace Alignment System, previously referenced herein.

Each individual heating section 12, 14 and 16 is programmed to heat up to a specific predetermined temperature, this temperature being potentially as high as 2200° C. or 4352° F. Each individual heating sections 12, 14 and 16 may also include a variety of different materials from those used in adjacent sections. These differing materials typically have respective coefficients of thermal expansion which differ from one another. As a result of the plurality of different factors affecting each section, each of the susceptors 20 will tend to heat up and cool down at a different rate than the susceptors in the adjacent heating sections and will consequently expand and contract at a different rate than the susceptors 20 in the heating sections disposed adjacent thereto. Furnace 10 may expand several inches in length because of the extremely high temperatures used in heating sections 12, 14 and 16. In a furnace of 60 feet in length, this expansion has been found to be as much as four inches.

Figure 4:
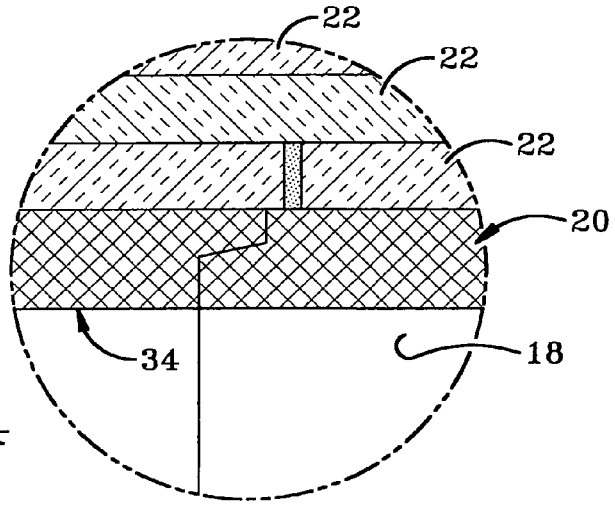
FIG. 4 is an enlargement of the highlighted area from FIG. 3.
Figure 5:
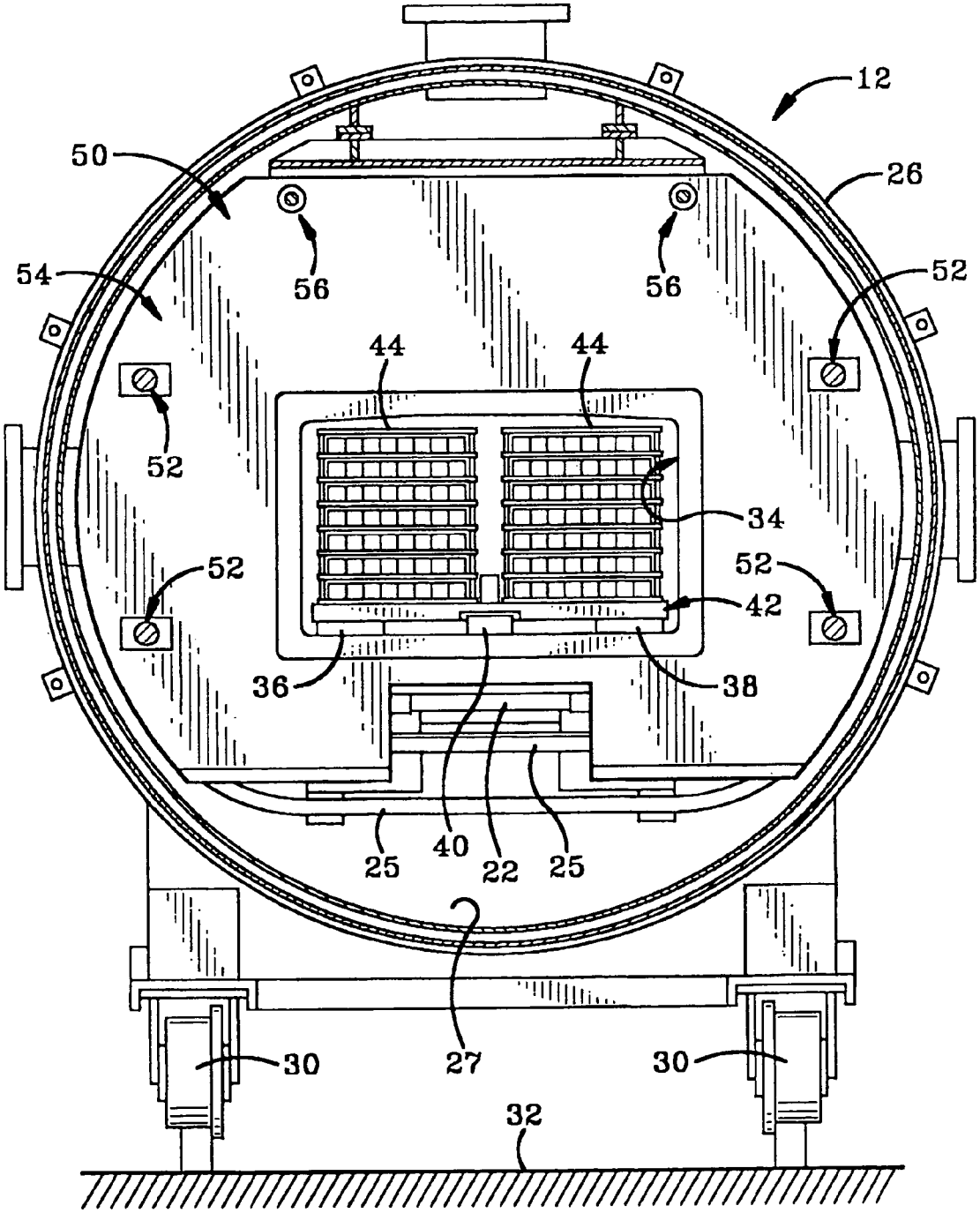
FIG. 5 is an end elevational view of the furnace through line 5-5 of FIG. 3.
Figure 6:
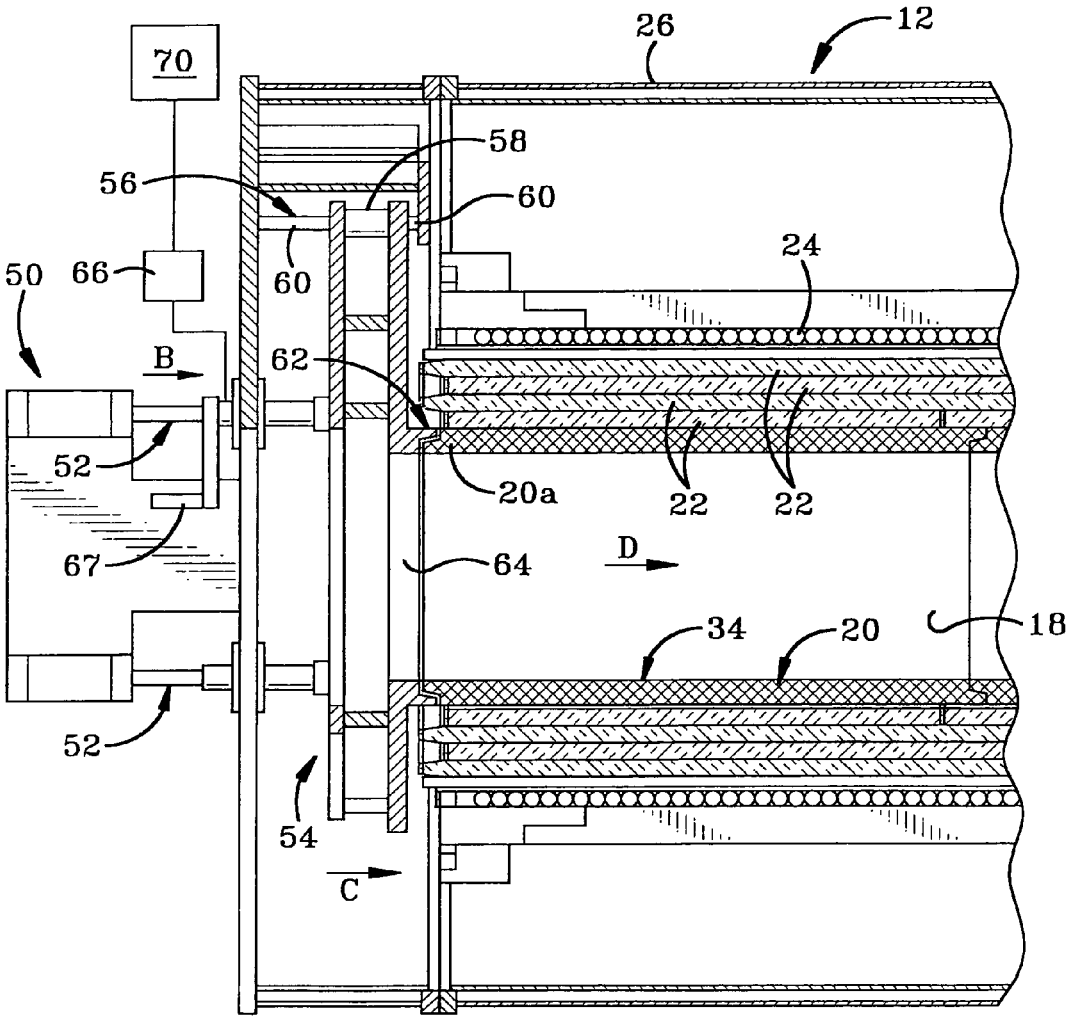
FIG. 6 is a cross-sectional side view of the first end of the pusher furnace showing the compression system engaged.

Prior to heating of heating sections 12, 14 and 16, the susceptors 20 and the associated insulation 22 are interlocked in the manner shown in FIG. 4. When heating sections 12, 14 and 16 are heated up, the susceptors 20 of adjacent heating chambers tend to stay interlocked with each other. If pusher furnace 10 is cooled or shut down for some reason, each of heating sections 12, 14 and 16 will tend to cool at a rate dictated by the thermal properties of the materials it is manufactured from. As heating sections 12, 14 and 16 cool, they tend to shrink in length. Furthermore, one of the problems with heating materials is that they may not return to exactly their original shape and length when they have been heated and then cooled. If susceptors 20 are not forced to remain in contact with each other as they contract during cooling, then a gap may form between the susceptors 20 of adjacent heating sections. Additionally, the adjacent susceptors 20 may not return to their original shape when they are reheated, allowing the gaps to persist even as the susceptors 20 expand once again. If these gaps are allowed to form, then heat and gasses and other materials would escape from within tunnel 34 when the furnace is reheated. So, for example, the gaps could allow materials such as silicone to impregnate the insulation layers 22, consequently causing damage to the same. Heat from within tunnel 34 will pass through the damaged and degraded insulation making its way to induction coil 24, melting the same and causing the water retained within coil 24 to turn to steam and explode. The oxygen released during this process could combine with the carbon in the system causing a self-sustaining fire.

Consequently, in accordance with a specific feature of the present invention, pusher furnace 10 is provided with a compression system, generally indicated at 50 to keep the susceptors 20 of adjacent heating sections 12, 14 and 16 interlocked with each other. Compression system 50 applies pressure to the susceptors 20 as required and thereby maintains the integrity of furnace 10 even though it may undergo a number of heating and cooling cycles.

Compression system 50 includes a plurality of pressure sensitive, torque electric actuators or hydraulic cylinders 52, a movable member in the form of a floating compression plate 54, a slide pin assembly 56 and, spaced a distance therefrom, a stationary member which in this instance is end wall 48. A compression spool 58 of slide pin assembly 56 is free to slide backward and forward on a pin 60 thereof. Furthermore, compression plate 54 has an annular flange or insert 62 that projects toward and substantially matches the face of the susceptor 20*a* of the first heating section 12. Thus, like the joints between adjacent susceptors 20, insert 62 and susceptor 20*a* form therebetween an overlapping shiplap joint. When compression plate 54 and susceptor 20*a* are engaged, they provide a positive, gas-tight seal which keeps all the process gasses internally within the heated chamber 12. Compression plate 54 includes an aperture 64 therethrough, which is substantially continuous with passageway 18 in heating section 12 and consequently with tunnel 34. Similarly, a stationary member, i.e., wall 48 is sealed with the susceptor of last heating section 16 in like manner to compression plate 54 and susceptor 20*a*. Second aperture 47 through end wall 48 is also substantially continuous with tunnel 34. Slide rails 36, 38 and guide rail 40 extend through apertures 64 and 47. Aperture 64 allows pusher plate 42, carrying the unprocessed materials 44 thereon, to be pushed into heating section 12 by pusher arm 46 and second aperture 47 allows pusher plate 42 carrying the now-processed materials 44 to exit heating section 16. Compression system 50 further includes a movement sensor in the form of a linear transducer 67 which measures the distance the compression plate 54 moves forwardly or rearwardly in response to actuation of cylinders 52. Compression system 50 is preferably also provided with one or more pressure sensors 66 (FIG. 3) and temperature sensors 68A-C (FIG. 1) which feed information to a computerized control system which is used to actuate and regulate the system 50. The control system is thus preferably automated and includes a computer 70 (FIGS. 1 and 3) which is in communication with pressure sensor 66 and temperature sensors 68, typically via electrical connectors.

The compression system 50 substantially keeps the shiplap joints between adjacent susceptors 20, and preferably layers of insulation 22 as well, tightly engaged and sealed and, through the linear transducer 67 and pressure and temperature sensors 66 and 68 monitors the thermal heating and cooling and related expansion and contraction of furnace 10 and activates and deactivates the hydraulic cylinders 52 as required. The sensors are linked into the controls of compression system 50 so that system 50 automatically applies more or less pressure to the susceptors 20 as they contract or expand. The potential formation of gaps between heating sections 12 and 14, and 14 and 16 is thereby substantially reduced.

The compression system 50 is preferably automated, but functions in the following manner. First, the thermal expansion coefficients and the temperature to which each section is to be heated is used to calculate the expansion/shrinkage profile for each susceptor in each of sections 12,14 and 16. The various induction coils are then powered to inductively heat the various susceptors within the furnace in order to heat the furnace to the operating temperature. During the heating of the furnace, the total expansion of the susceptors is measured via the use of transducer 66 or a similar sensor. When heating sections 12, 14 and/or 16 of furnace 10 cool down for one reason or another, a plurality of sensors provided on each of the individual heating sections 12, 14 and 16, in conjunction with the sensors provided on compression system 50 send a signal to the compression system control center. The control center actuates the hydraulic cylinders 52 to move as indicated at Arrow B in FIG. 6 to apply pressure to compression plate 54, advancing the same along axis A-A, as indicated by Arrow C in FIG. 6. As compression plate 54 is in engaging contact with susceptor 20*a*, the susceptor 20*a* is forced in the direction of travel through furnace 10 as indicated at Arrow D in FIG. 6. The motion of the susceptor 20*a* in heating section 12 is transferred to the susceptor in heating section 14, then to the susceptor in heating section 16. The end (not shown) of the susceptor in heating section 16 engages wall 48 in the same manner as insert 62 of compression plate 54 engages susceptor 20*a*, and is represented by the latter configuration shown in FIG. 3. The sensors on heating sections 12, 14 and 16 and the compression system sensors continuously feed pressure and linear information back to the controls for compression system 50. As the furnace cools, linear transducer 67 or the like senses the total shrinkage of the susceptors in order to compare the actual shrinkage to the shrinkage profile to ensure that the difference therebetween is within a predetermined value in order to ensure that the seal between the susceptors and between the susceptors and compression plate and stationary wall are not compromised. Preferably, compression plate 54 applies a constant pressure to the first susceptor 20*a* during the cooling process although the system may also be operated to allow a predetermined amount of shrinkage based on the shrinkage profile so that there is relative movement between abutting susceptors which is no greater than the overlapping joints, to be followed by pressure via compression plate 54 to keep susceptors 20 in abutment with one another and prevent any gaps from forming therebetween. When predetermined linear travel and/or sufficiently increased pressure readings are received by the controls for compression system, the cylinders 52 are stepped down and no further pressure is applied thereby to compression plate 54. An additional advantage of the system is the ability to compare the actual shrinkage to the shrinkage profile so that if a sufficient difference exists between the two but the seal is not compromised, it may be ascertained that a bad joint or joints exist which need to be checked before the furnace is reheated.

When furnace 10 is fired up, the susceptors 20 will begin to expand once more. As they expand, the sensors on heating sections 12, 14 and 16 and the linear transducer 66 and sensors on compression system 50 feed information to the compression system controls which then retract cylinders 52 in response to the rate of expansion. This causes compression plate 54 to move in the direction opposite to the direction of travel through furnace 10. When susceptors 20 within furnace 10 are fully expanded, cylinders 52 cease to move. Thus all joints between adjacent susceptors are kept fully interlocked and the heat and process gasses are contained within tunnel 34. If desired, plate 54 may apply pressure on susceptor 20*a* toward the susceptor 20 in section 16 while moving away from the susceptor 20 of section 16.

Figure 7:
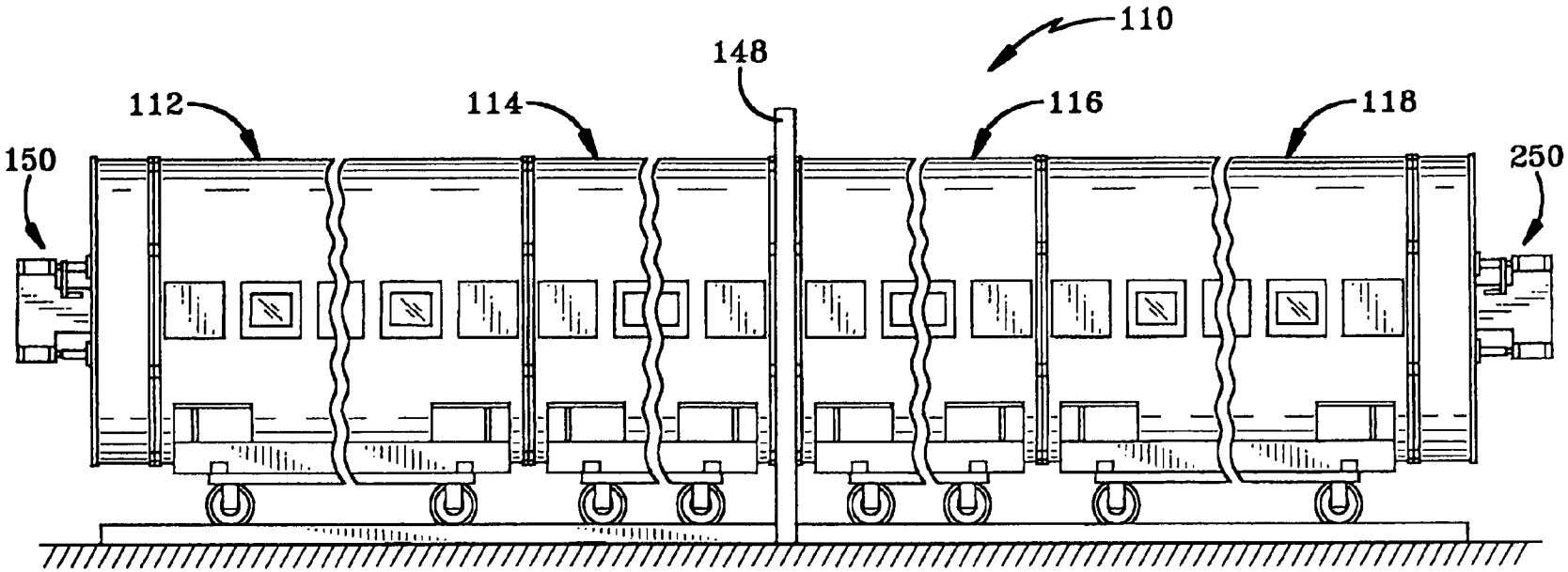
FIG. 7 is a side elevational view of a second pusher furnace having a pair of compression systems engaged therewith; the compression systems being configured to apply pressure to both ends of the longitudinally extending furnace.

FIG. 7 illustrates a furnace system 110 which includes a stationary wall 148 disposed in the middle of a plurality of heating sections 112, 114, 116 and 118. A compression system 150 is used to monitor and apply pressure as needed to heating sections 112 and 114. A second compression system 250 is used to monitor and apply pressure as needed to heating sections 116 and 118. As will be understood, compression systems 150 and 250 apply pressure in opposite directions, and this is possible because wall 148 separates heating sections 114 and 116 and that wall 148 is stationary. All other components in this system operate in the manner previously described in relation to furnace 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a furnace unit having first and second opposed ends and including a plurality of furnace sections each having a susceptor;

wherein each susceptor abuts an adjacent susceptor;

wherein the susceptors include first and last susceptors respectively adjacent the first and second ends of the furnace unit;

a pusher arm which is movable relative to the susceptors and adapted to push a plurality of pusher plates relative to the susceptors through the furnace sections;

a movable member which is distinct from the pusher arm and abuts the first susceptor for applying a force on the first susceptor toward the last susceptor whereby the movable member is adapted to keep the susceptors in abutment with each other during contraction of the susceptors during cooling thereof; and an actuator for moving the movable member.

2. The apparatus of claim 1 wherein the susceptors define respective passages which are in communication with one another to form a tunnel adapted to receive therethrough pusher plates for carrying loads thereon to be heated in the furnace unit.

3. The apparatus of claim 2 further including at least one slide rail which is adapted for slidably receiving the pusher plates thereon and which extends through the tunnel from adjacent the first end to adjacent the second end of the furnace unit.

4. The apparatus of claim 3 wherein the movable member defines an aperture which communicates with the tunnel and is adapted to allow the pusher plates to pass therethrough.

5. The apparatus of claim 4 wherein the at least one slide rail extends through the aperture in the movable member.

6. The apparatus of claim 4 further including a stationary member which abuts the last susceptor; wherein the susceptors are disposed between the movable member and the stationary member; and wherein the stationary member defines an aperture which communicates with the tunnel and is adapted to allow the pusher plates to pass therethrough.

7. The apparatus of claim 2 wherein abutting susceptors abut one another via respective overlapping joints.

8. The apparatus of claim 2 wherein the tunnel is sealed against the escape of gasses therefrom.

9. The apparatus of claim 2 wherein the movable member abuts the first susceptor via an overlapping joint.

10. The apparatus of claim 1 further including a stationary member which abuts the last susceptor; and wherein the susceptors are disposed between the movable member and the stationary member.

11. The apparatus of claim 1 wherein the furnace unit includes at least one slide rail adapted for slidably receiving pusher plates thereon.

12. The apparatus of claim 11 wherein the at least one slide rail is seated on the susceptors.

13. The apparatus of claim 1 further including at least one movement sensor for measuring a degree of at least one of thermal expansion and contraction of the susceptors.

14. The apparatus of claim 13 wherein the at least one movement sensor includes a linear transducer which is operationally connected to the movable member and is adapted to measure the distance traveled by the movable member.

15. The apparatus of claim 1 further including a pressure sensor operationally connected to the movable member for sensing a degree of pressure applied by the movable member to the first susceptor.

16. The apparatus of claim 1 wherein the movable member is slidably movable toward and away from the last susceptor.

17. The apparatus of claim 1 further including at least one support structure on which the susceptors are slidably mounted to allow for sliding movement of the susceptors during thermal expansion and contraction of the susceptors.

18. The apparatus of claim 17 wherein the support structure includes a graphoil layer on which the susceptors are slidably mounted to allow for the sliding movement.

19. The apparatus of claim 17 further including refractory insulation disposed below the susceptors; and wherein the at least one support structure supports the susceptors so that the susceptors are spaced above the insulation to protect the insulation from degradation from contact with the susceptors.

20. The apparatus of claim 1 further including an automated control unit which is in communication with the actuator for controlling movement of the movable member.

21. The apparatus of claim 1 further including the pusher plates; and wherein the pusher plates move relative to the susceptors through the furnace sections when pushed by the pusher arm.

* * * * *